United States Patent [19]

Maynard

[11] Patent Number: 4,772,021

[45] Date of Patent: Sep. 20, 1988

[54] INFLATABLE SUSPENSION TUBE FOR GAME RACKET HEAD

[76] Inventor: Michael B. Maynard, 4804 SE. 28th Dr., No. 515, Portland, Oreg. 97202

[21] Appl. No.: 879,819

[22] Filed: Jun. 27, 1986

[51] Int. Cl.[4] ..... A63B 51/12

[52] U.S. Cl. ..... 273/73 C; 273/73 E; 273/73 L

[58] Field of Search ..... 273/73 R, 73 C, 73 D, 273/73 E, 73 L; 152/511, 512, 455, 456, 450, DIG. 16

[56] References Cited

U.S. PATENT DOCUMENTS

| | | | |
|---|---|---|---|
| 584,289 | 6/1897 | Morgan | 152/512 |
| 1,372,417 | 3/1921 | Gardner | 152/371 |
| 2,512,774 | 6/1950 | Musselman | 152/511 X |
| 4,357,012 | 11/1982 | Maynard | 273/73 L |

FOREIGN PATENT DOCUMENTS

| | | | |
|---|---|---|---|
| 320183 | 10/1929 | United Kingdom | 273/73 E |

*Primary Examiner*—Richard C. Pinkham
*Assistant Examiner*—William Stoll
*Attorney, Agent, or Firm*—Chernoff, Vilhauer, McClung & Stenzel

[57] ABSTRACT

An inflatable generally toroidal suspension tube for resiliently suspending and retaining a stringed inner frame insert within an outer frame of a racket head. Different parts of the tube are able to expand at different rates in response to increased inflation pressure, so as to control distortion of the outer frame of the racket head. The tube may be of a thermoplastic material and tubular restrictors surround the portions of the suspension tube which are intended in use to be located where the radius of curvature of the frame is greatest, in order to prevent distortion of those parts of the racket head frame.

20 Claims, 2 Drawing Sheets

INFLATABLE SUSPENSION TUBE FOR GAME RACKET HEAD

BACKGROUND OF THE INVENTION

The present invention relates to sports rackets such as tennis rackets, and particularly to an improved inflatable suspension tube for use in a gas-suspension racket of the type having a stringed insert located within a surrounding outer frame and mechanically coupled resiliently with the outer frame by the presence of such a suspension tube within opposing channels defined on the interior of the outer frame and the exterior of the insert.

Maynard U.S. Pat. No. 4,357,012 discloses a sports racket having a removable stringed insert located within a surrounding outer frame and connected with the outer frame by an inflatable tube located between the outer frame and the inner frame and extending within opposing channels surrounding the exterior of the inner insert and the interior of the outer frame. Such a racket is intended to provide better power in striking a ball, and to avoid transmitting the shock of striking the ball to the player's elbow joint. For a tennis racket of this type to be completely satisfactory, it must be able to be manufactured in an embodiment which is not too heavy and in which the balance of the complete racket is such that the racket is not excessively head-heavy. If the racket is too head-heavy, a player will not be able to swing it quickly enough or control it precisely enough to strike a ball as desired.

One of the objectives of a gas-suspension racket is to provide resiliency to cushion the handle of the racket from the shock of the strings striking a ball, but without having to loosen the tension of the strings of the racket to provide such cushioning. The suspension of the insert within the outer frame by a resilient gas-filled suspension tube achieves this objective, but only if a certain amount of clearance is maintained between the inwardly-facing surfaces of the outer frame and the outwardly-facing surfaces of the insert. This clearance is required in order for the insert to be able to move predictably in response to striking a ball, with relative movement being opposed, and the original position of the insert being restored, by the elasticity of the suspension tube and the gas contained within it.

The heads of most sports rackets are oval, not circular. As a result, an inflatable suspension tube having uniform dimensions along its entire circumference exerts a greater force toward the longer opposite sides of the head of a gas-suspension racket, where the radius of curvature is usually greater, than toward the top and bottom of the racket head, because of the greater length over which the force tending to expand the suspension tube is exerted in opposite directions between the insert and the outer frame of the racket head. If the racket head frame and the frame of the insert are of uniform dimensions about their entire circumferences, there will be a resulting tendency of the sides of the outer frame of the racket head to be displaced outwardly and for the top to move slightly toward the throat of the racket, reducing clearance between the outer frame and the insert at the top and throat. This force exerted by the suspension tube may also effectively loosen the horizontal strings by distorting the frame of the insert.

While it might be possible to design a racket head having a combination of frame and insert in which distortion of the frame with a particular inflation pressure in the suspension tube would result in the desired clearances, the result is likely to be difficulty in removal and replacement of the insert. It is also generally not practical to design such a racket head, because of the different amounts of pressure which players might desire to use under different playing conditions. Such different pressures in the suspension tube could well result in unacceptable variation of the clearances between the racket head's outer frame and the insert.

Loss of clearance between the outer frame and the insert may cause interference between the frame and the insert at times during play, which makes the response of the racket somewhat unpredictable. Interference between the racket head's outer frame and the insert also eliminates the desirable ability of the suspension tube to absorb and restore energy as the ball strikes the strings and rebounds away from the racket. Such interference also results in shock being transmitted from the racket strings to the handle of the racket, defeating one of the main objectives of the gas-suspension racket.

While use of sturdy enough construction of a racket head outer frame and insert frame, or use of a low inflation pressure of the suspension tube, might result in avoiding problems of mechanical interference between the outer frame and the frame of the insert, it is usually desirable to inflate the suspension tube to a relatively high pressure, in order to retain the insert securely within the outer frame and to provide a desired amount of mechanical coupling between the racket handle and the insert. These objectives must be achieved, however, without the head of the racket becoming unacceptably heavy as a result of the structure used.

What is needed, therefore, is an improved suspension tube structure for use in a game racket of the type described, which enables the suspension tube to be pressurized to a high enough pressure to couple the insert firmly to the outer frame, without distorting the outer frame of the racket head, without an unacceptable racket head weight, without loss of resiliency of the suspension tube, and while retaining ample flexibility of the suspension tube to permit replacement of the insert within the outer frame of the racket head by deflating the suspension tube.

SUMMARY OF THE INVENTION

The present invention overcomes the shortcomings of previously-known inflatable suspension tubes for use in interconnection between a stringed insert and an outer frame of the head of a sports racket of the gas-suspension type disclosed in Maynard U.S. Pat. No. 4,357,012. The suspension tube of the present invention is an elastic, thin-walled, lightweight main tube in the form of a loop, having at least one, and in the usual case a pair, of oppositely located restricted portions formed, for example, by restrictor tubes surrounding respective parts of the main tube which are located along the sides of a sports racket having an oval head. Thus, the restrictor tubes are located along those portions of the frame of the racket head where the radius of curvature is greatest, controlling the amount of expansion of those portions of the suspension tube in response to increases in gas pressure within the tube. As a result, the restricted portions of the suspension tube exert less pressure on the outer frame and insert than do other parts of the suspension tube, so that the outer frame of the racket and the frame of the insert will not be distorted relative to one another.

It is therefore a principal object of the present invention to provide an inflatable suspension tube for a gas-suspension sports racket which will not cause distortion of the racket head's outer frame.

It is another object of the present invention to provide such an inflatable suspension tube which is light in weight, yet may be used at a suitably high pressure to secure an insert within the outer frame of a gas-suspension sports racket.

It is an important feature of the inflatable suspension tube of the present invention that it is constructed of thin-walled plastic tubing material, with restrictor tubes of similar material surrounding portions of the main tube.

It is an important advantage of the present invention that it permits the outer frame and the frame of the inner insert of a gas-suspension racket to be lighter in weight than would be possible without the invention, thus improving the balance of a racket of such construction.

It is another advantage of the present invention that it provides an inflatable suspension tube for a gas-suspension racket which results in a racket which performs better than do rackets with previously-known suspension tubes.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
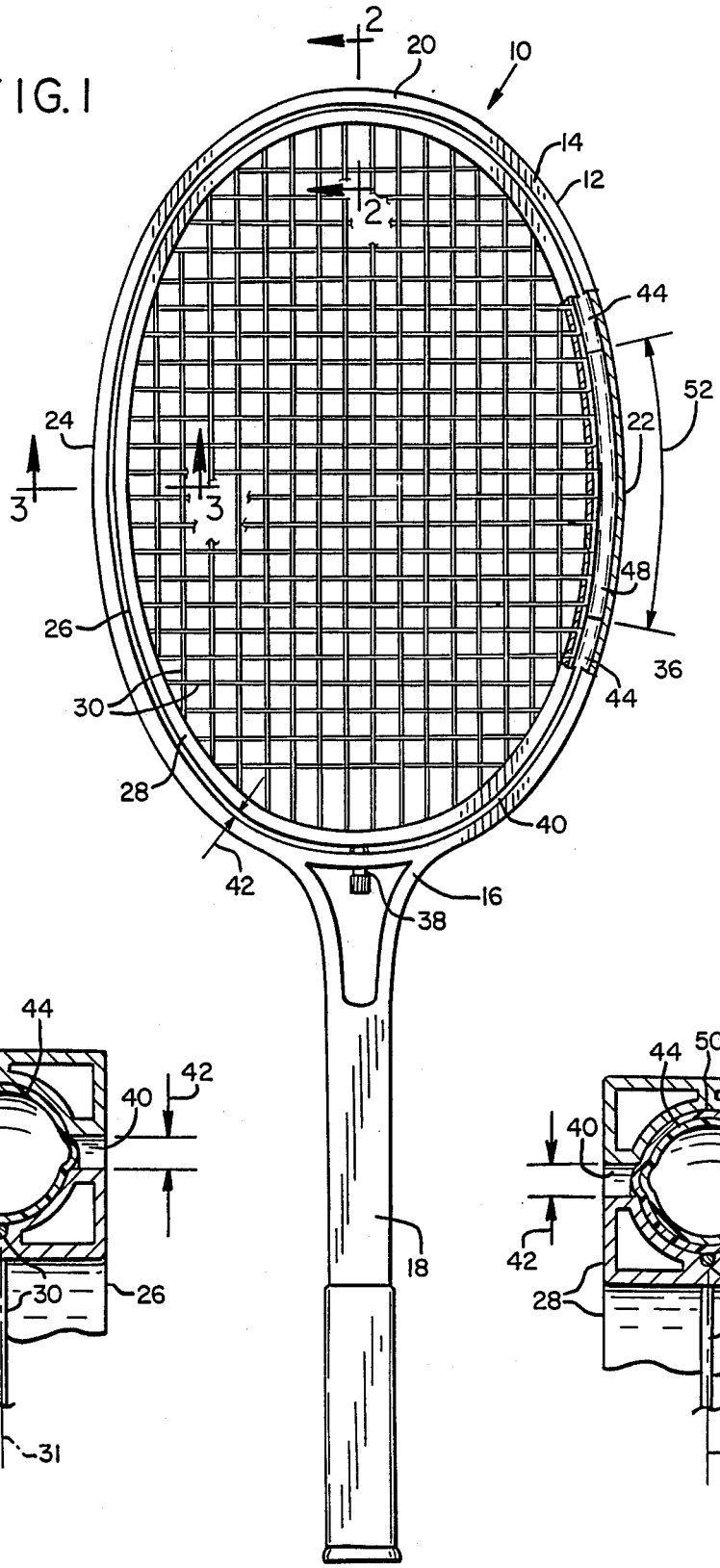
FIG. 1 is a partially cutaway front view of a gas-suspension tennis racket embodying the present invention.

Referring now to the drawings, in FIG. 1 a tennis racket 10 has a head 12 including an oval outer frame 14 attached at a throat area 16 of the racket to a handle 18. The head 12 includes a top 20 and a pair of opposite sides 22 and 24.

As is apparent, the head 12 is oval in shape, and the radius of curvature of the outer frame 14 is greater at the sides 22 and 24 than it is at the top 20 and throat area 16. Situated within the outer frame 14 is a stringed insert 26 including an insert frame 28 and strings 30 which are stretched tightly upon the frame 28 in the usual manner to provide a string plane 31 (FIGS. 2, 3) of the racket 10 parallel to the plane of FIG. 1.

Figure 2:
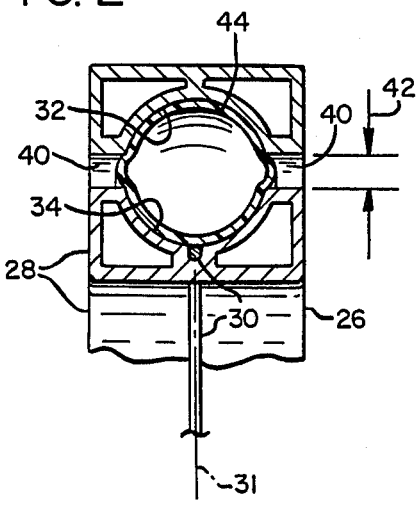
FIG. 2 is a sectional view of the racket shown in FIG. 1, taken along line 2—2, at an enlarged scale.
Figure 3:
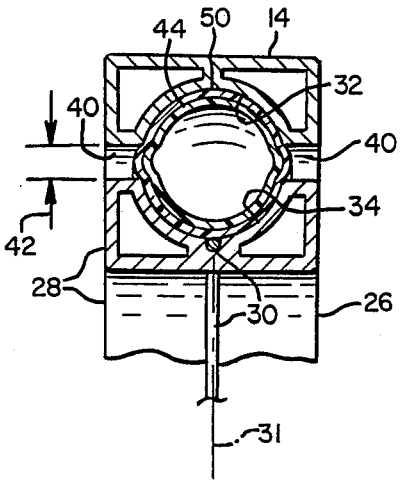
FIG. 3 is a sectional view of the racket shown in FIG. 1, taken along line 3—3, at an enlarged scale.
Figure 4:
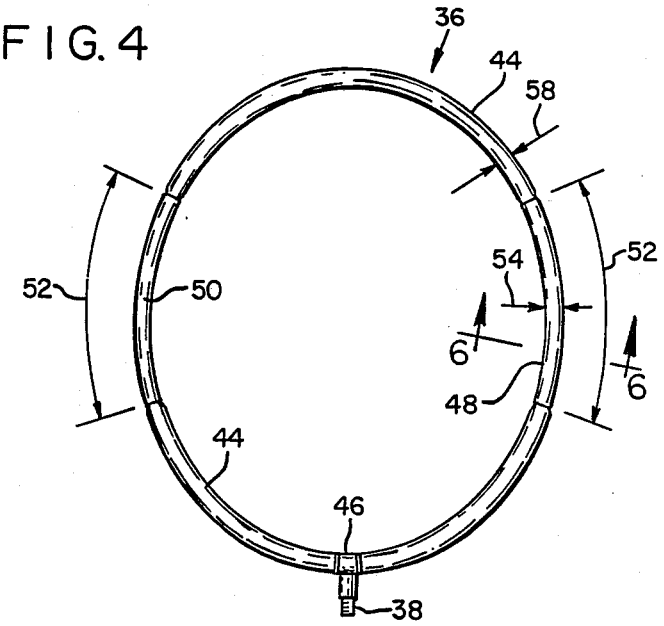
FIG. 4 is a front view of an inflatable suspension tube according to the present invention.
Figure 5:
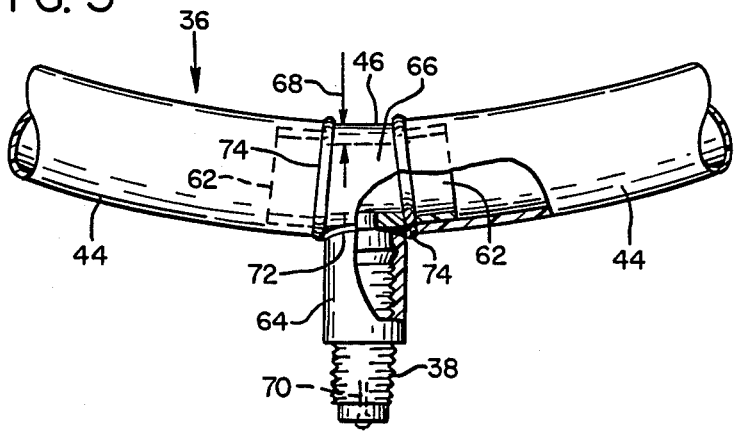
FIG. 5 is a detail view, at an enlarged scale, of a portion of the inflatable suspension tube shown in FIG. 4, including the inflation valve.

Referring now also to FIGS. 2 and 3, it may be seen that the outer frame 14 defines a first channel 32, of arcuate profile and slightly shallower than a semicircle, which faces inwardly along the entire outer frame 14. The frame 28 of the insert defines an outwardly-facing second channel 34 located opposite the first channel 32 and having a similar shape and size. The second channel 34 extends about the entire circumference of the insert frame 28.

Located partially within each of the first and second channels 32, 34, and thus between the outer frame 14 and the frame 28 of the insert 26, is an inflatable suspension tube 36. The suspension tube 36 is generally toroidal in shape, except for an inflation valve stem 38 which extends generally radially outwardly and is exposed in the throat area 16 of the racket 10.

The inflatable suspension tube 36, by being engaged within the first and second channels 32 and 34, maintains the insert 26 in a position generally coplanar with the outer frame 14 of the racket head 12, although some relative motion is permitted by the resilient nature of the suspension tube 36, which will be described in greater detail subsequently.

Between the frame 28 of the insert 26 and the outer frame 14 of the head 12, on each side of the inflatable suspension tube 36, is a space 40 surrounding the insert 26 and providing a clearance distance 42, which permits the insert 26 to move a small distance in any direction within the outer frame 14. The amount of relative movement which will occur depends upon the compressibility and elasticity of the inflatable suspension tube 36 when it is inflated. Differences of the material of which the suspension tube 36 is made, as well as differences in the pressure of inflation of the suspension tube 36, will result in differences in the amount of relative movement of the insert 26 within the outer frame 14 in response to a particular amount of force being applied against the strings 30.

Preferably, the suspension tube 36 is of flexible thin-walled tubular construction, with a main tube portion 44 being, for example, a tubular extrusion of ether base polyurethane plastic. In forming the main tube 44 a piece of the tubular material is bent into the shape of a continuous closed loop, and the opposite ends are thermally welded to respective arms of a T-shaped valve fitting 46 of which the inflation valve stem 38 is the stem of the T. Restrictive sleeves, such as a pair of restrictor tubes 48 and 50, surround portions of the main tube 44 located along the opposite sides 22 and 24 of the racket 10 when the suspension tube 36 is installed in the racket 10. The same material is preferred for construction of the main tube 44, the T-shaped fitting 46, and the restrictor tubes 48 and 50. This material may best be joined by thermal welding, in constructing the inflatable suspension tube 36. The polyurethane material is available in formulations having several different degrees of hardness, and each different formulation of the material has its own ranges of melting and softening temperatures. For that reason, it is desirable to use materials of the same hardness for the main tube 44 and the T-shaped fitting 46.

It would be possible to contruct a suspension tube 36 in which portions of the main tube 44 are replaced by lengths of tubing corresponding to the locations of the restrictor tubes 48 and 50, with the replacement lengths of tubing having a greater wall thickness or otherwise having a greater resistance to expansion than the remainder of the main tube 44. However, it is considered most practical to provide restrictor tubes 48 and 50, while providing an integral structure of the main tube 44, in order to ensure airtightness of the tube 36 most easily.

The dimensions of the restrictor tubes 48 and 50 are chosen so that the tubes cooperate with the particular main tube 44, in view of the pressure to which the suspension tube 36 is to be inflated, and in view of the total weight of the suspension tube 36 which is tolerable, given the desired weight and balance of the racket 10. In any case, the objective of providing restricted portions of the suspension tube 36 is to reduce the amount of force exerted outwardly against the outer frame 14 in the vicinity of the sides 22 and 24. Excessive force in those areas would tend to increase the size of the space 40 beyond the desired clearance distance 42 in those vicinities and thereby to reduce the size of the space 40 to an undesirably small clearance in the top region 20 and throat region 16 of the racket 10. The restricted portions of the suspension tube 36, at the intended inflation pressure, provide ample support to help retain and support the insert 26 in the outer frame 24, but do not expand far and forcefully enough to distort the outer frame 14 and insert frame 28 unacceptably.

Figure 6:
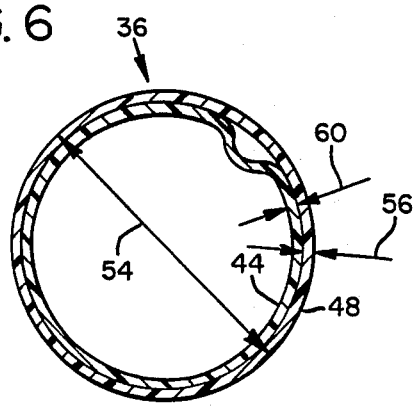
FIG. 6 is a sectional view of the inflatable suspension tube shown in FIG. 4, taken along line 6—6, at an enlarged scale.

Each of the restrictor tubes 48 and 50 has a length 52, a diameter 54 and wall thickness 56 (FIG. 6). Similarly, the main tube 44 has a diameter 58 and a wall thickness 60. Acceptable combinations of restrictor tube wall thickness 56, restrictor tube diameter 54, main tube diameter 58, main tube wall thickness 60, and restrictor tube length 52 depend on the total weight which is tolerable for the entire suspension tube 36 and the racket 10, and also upon the pressure to which the suspension tube 36 is desired to be inflated, and upon the degree of resilient freedom or mechanical coupling desired between the racket's outer frame 14 and the insert 26. To some extent, these factors are determined by personal preference of a person who will use the racket 10. In general, however, it is desirable to have the total weight of the suspension tube 36 be as small as possible consistent with the pressure to be sustained.

The diameter 58 of the main tube 44 is preferably no greater than, and usually slightly less than, the diameter of the circle defined jointly by the first and second channels 32 and 34 when the insert 26 is properly located with respect to the outer frame 14. When the suspension tube 36 is fully inflated to the normal pressure the main tube 44 will expand to fill the available space, as shown in FIGS. 2 and 3. The amount of expansion required should be within the elastic limit of the material. The diameter 54 of the restrictor tubes 48 and 50 is chosen to be equal to or less than the diameter of the circle defined jointly by the first and second channels 32 and 34 as described above, and is usually chosen to be equal to or smaller than the diameter 58 of the main tube 44, as indicated in FIG. 6, which shows the suspension tube 36 uninflated. However, this difference in original diameter between the main tube 44 and the restrictor tubes 48 and 50 is accommodated upon inflation of the suspension tube 36, as both the main tube 44 and the restrictor tubes 48 and 50 expand as a result of the inflation pressure within the suspension tube 36, and the restrictor tubes 48 and 50 may take on a permanently expanded set after inflation.

Plastic material whose wall thickness 56 ranges from 0.007 inch to 0.015 inch, with a 13/32-inch outside diameter 58, has been found satisfactory for the main tube 44 where the diameter of the circle defined by the first and second channels 32 and 34 is 7/16 inch and the clearance distance 42 is 1/16 inch. Thermoplastic ether base polyurethane materials having durometer hardnesses of 80 or 90 on the A scale or 55 on the D scale have been found to be satisfactory.

Restrictor tubes 48 and 50 having a diameter 54 of 5/16 inch and a wall thickness 56 of 0.01 inch and a durometer hardness of 80 (A) have been found satisfactory in lengths 52 of 2 inches to 8 inches for use with a main tube 44 having a wall thickness 60 of 0.007 inches and a durometer hardness of 55 (D), resulting in a suspension tube 36 which is relatively light in weight. In such a suspension tube 36, it would usually be desirable to keep the internal gas pressure below 80 pounds per square inch.

In contrast, however, to obtain maximum stiffness and torsional stability of the insert 26 relative to the outer frame 14 of a racket head 12, it would be possible to use a main tube 44 having a diameter 58 of 13/32 inch and a wall thickness 60 of 0.015 inch of polyurethane material having a durometer hardness of 55 (D) with restrictor tubes 48, 50 of similar material having a wall thickness 56 of 0.015 inch, a diameter 54 of 13/32 inch, and a length 52 of 3 inches to 5 inches, with a suspension tube inflation pressure of 100 psi or more.

For a small "midsize" tennis racket having a stringed face area of approximately 84 square inches, a good combination for a player of average ability is a main tube 44 of 55 (D) durometer hardness polyurethane plastic having a diameter of 13/32 inch, and a wall thickness 60 of 0.011 inch, together with a restrictor tube 48 or 50 of the same plastic having a diameter 54 of 11/32nds inch, a wall thickness 56 of 0.015 inch, and a length 52 of about 5 inches, inflating the suspension tube 36 to a pressure in the range of 60 to 80 psi.

The inflatable suspension tube 36 of the present invention is manufactured by selecting the material, the diameter 58 and wall thickness 60 for the main tube 44, selecting the material, the diameter 54, wall thickness 56, and length 52 of tubing to be used for the restrictor tubes 48 and 50. A length of the material for the main tube 44 which is long enough to fit around the insert 26 in the channel 34 without excessive slack length is selected, for example 34 inches to 36 inches for a typical tennis racket having a striking surface area of 84 square inches. The restrictor tubes 48 and 50 are cut to the desired length and then slid over the main tube 44, using lubrication if necessary. The length 52 needed varies depending on the diameter 54 and wall thickness 56, as well as the shape of the head 12, but the length 52 should usually be at least 2 inches, unless multiple restrictor tubes 48 and 50 are used on a single side of the head 12.

Preferably, short spacer rings 62 about ¼ inch long and having a wall thickness of, for example, 0.03 inch are placed within the ends of the main tube 44 to provide support and additional material for thermal welding to the T-shaped fitting 46.

The T-shaped fitting 46 is manufactured by thermally welding a boot 64 of plastic tubing as at 72 to the plastic tubing of the cross member 66, which has a wall thickness 68 of, for example 0.0625 inches and is, for example, ½ inch long and 0.3125 inches in outside diameter. The ends of the main tube 44, with spacer rings 62 inside, are thermally welded as at 74 to the respective ends of the cross member 66. An opening is made through the wall of the cross member 66 within the tubular boot 64, and a commercially-available threaded plastic valve stem is cemented in place within the boot 64, using, for example, a cyano-acrylate ester adhesive. A spring-loaded valve of the type used for inflating pneumatic tires is provided within the valve stem 38 to maintain pressure within the suspension tube 36 when it is inflated.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An inflatable suspension tube for use in retaining and supporting a frame of a stringed insert portion located within and resiliently coupled with an outer frame portion of the head of a gas-suspension sports racket, the inflatable suspension tube comprising:

(a) an expansible, inflatable, endless closed loop of tubular structure;

(b) valve means associated with said loop for inflating said loop, said loop, when inflated, defining an annulus;

(c) restrictor means for encircling portions of said inflatable loop and for limiting the rate of expansion of said portions with respect to the remainder of said loop; and (d) at least two of said restrictor means being arranged diametrically opposed to each other on said annulus, each of said restrictor means being positioned substantially one quadrant of said annulus away from said valve.

2. The inflatable suspension tube of claim 1 wherein said restrictor means include surrounding sleeves located on said respective portions of said loop.

3. The inflatable suspension tube of claim 2 wherein said loop and said sleeves are of flexible, elastic, plastic material.

4. The inflatable suspension tube of claim 1 wherein said restrictor means are of material similar to that of the remainder of said loop, but are of thicker construction.

5. An inflatable suspension tube for use in retaining and supporting an oval-shaped frame of a stringed insert portion located within and resiliently coupled with an oval-shaped outer frame portion of the head of a gas-suspension sports racket, the inflatable suspension tube comprising:

(a) an inflatable main tube defining a closed loop of flexible tubing;

(b) valve means associated with said main tube for inflating said main tube, said main tube, when inflated in association with said oval-shaped frame, adapted to define an oval-shaped annulus having a pair of opposed narrow ends and pair of opposed broad sides;

(c) restrictor means encircling portions of said main tube for limiting the expansion of said respective portions of main tube located within said restrictor means so that said respective portions of said main tube are able to expand only at a smaller rate than the remainder of said main tube, in response to increasing inflation pressure; and (d) at least two of said restrictor means arranged diametrically opposed to each other on said opposed broad sides of said oval-shaped annulus.

6. The inflatable suspension tube of claim 5 wherein said main tube and said restrictor means are both of thin-walled tubular plastic material.

7. The inflatable suspension tube of claim 6 wherein said main tube and said restrictor means each have the same diameter and wall thickness when in a relaxed state prior to inflation.

8. The inflatable tube of claim 5 wherein said restrictor means includes a surrounding sleeve at least 2 inches long.

9. The inflatable tube of claim 5 wherein said main tube has a wall thickness and said restrictor means comprises a surrounding sleeve of tubular plastic material having a wall thickness at least as great as the wall thickness of said main tube.

10. The inflatable tube of claim 5 wherein said main tube has a wall thickness and said restrictor means comprises a surrounding sleeve of tubular plastic material having a wall thickness less than the wall thickness of said main tube.

11. The inflatable tube of claim 5 wherein said main tube has a diameter and said restrictor means includes a surrounding sleeve having a diameter which is smaller than the diameter of a portion of said main tube other than said respective portions where said restrictor means are located.

12. The inflatable tube of claim 5 wherein said main tube and said restrictor means are of thin-walled thermoplastic material having respective wall thicknesses and wherein said valve means is attached to said closed loop by a T-shaped fitting having a pair of arms to which respective ends of said main tube are communicatingly and sealingly attached, said T-shaped fitting having a wall thickness which is greater than the wall thickness of said main tube.

13. In combination with a gas-suspension sports racket of the type having a head including an outer frame attached to a handle and defining an interior channel, and a stringed insert having a frame defining a circumferential exterior channel, a suspension tube for interlockingly fitting within the respective interior and exterior channels of said frame and stringed insert and resiliently coupling the insert to the outer frame, the suspension tube comprising:

(a) a toroidal main tube located in said interior and exterior channels;

(b) valve means connected with said main tube for inflating said suspension tube; and (c) restrictor tube means located surrounding a portion of said main tube for limiting the rate of expansion of said portion of said main tube to a smaller rate of expansion that that of the remainder of said main tube means in response to increased fluid pressure within said suspension tube.

14. The combination of a gas-suspension sports racket and a suspension tube as defined in claim 13, including a plurality of apart-spaced restrictor tube means for limiting the rate of expansion of respective portions of said main tube.

15. The combination of a gas-suspension sports racket and a suspension tube as defined in claim 13 wherein said racket head includes a pair of opposite sides, said suspension tube including a pair of said restrictor tube means spaced apart from one another and located opposite each other and adjacent respective sides of said racket head.

16. The combination of a gas-suspension sports racket and a suspension tube as defined in claim 13 wherein said main tube has an outside diameter and is of elastic thermoplastic material and wherein said restrictor tube means is of thermoplastic material and has an outside diameter which is no greater than the outside diameter of the main tube.

17. The combination of a gas-suspension sports racket and a suspension tube as defined in claim 13 wherein said main tube and said restrictor tube means have respective tube wall thicknesses, the tube wall thickness of said restrictor tube means being greater than that of said main tube.

18. The combination of a gas-suspension sports racket and a suspension tube as defined in claim 13 wherein both said main tube and said restrictor tube means are of thermoplastic polyurethane material and wherein said restrictor tube means has a greater hardness than said main tube.

19. The combination of a gas-suspension sports racket and a suspension tube as defined in claim 13 wherein said racket head defines a racket string plane, including a plurality of restrictor tube means located along said main tube where said racket head outer frame, as seen in said racket string plane, has a maximum radius of curvature.

20. The combination of a gas-suspension sports racket and a suspension tube as defined in claim 13 wherein said main tube has respective top, bottom, and side portions, including a pair of restrictor tube means located respectively at opposite side portions of said main tube.

* * * * *